US010150656B2

(12) United States Patent
Dong et al.

(10) Patent No.: US 10,150,656 B2
(45) Date of Patent: Dec. 11, 2018

(54) MOBILE COUNTERWEIGHT MECHANISM OF A HOISTING MACHINE AS WELL AS A HOISTING MACHINE

(71) Applicant: XUZHOU Heavy Machinery Co., LTD., Jiangsu (CN)

(72) Inventors: Quan Dong, Jiangsu (CN); Mengbing Zhu, Jiangsu (CN); Yongjian Deng, Jiangsu (CN); Hongshu Guo, Jiangsu (CN)

(73) Assignee: XUZHOU Heavy Machinery Co., LTD., Xuzhou (CN)

( * ) Notice: Subject to any disclaimer, the term of this patent is extended or adjusted under 35 U.S.C. 154(b) by 14 days.

(21) Appl. No.: 15/543,108

(22) PCT Filed: Jan. 28, 2015

(86) PCT No.: PCT/CN2015/071686
§ 371 (c)(1),
(2) Date: Jul. 12, 2017

(87) PCT Pub. No.: WO2016/119135
PCT Pub. Date: Aug. 4, 2016

(65) Prior Publication Data
US 2017/0355577 A1 Dec. 14, 2017

(51) Int. Cl.
*B66C 23/76* (2006.01)
*B66C 23/78* (2006.01)

(52) U.S. Cl.
CPC ..... *B66C 23/76* (2013.01); *B66C 23/78* (2013.01)

(58) Field of Classification Search
CPC ..... B66C 23/76; B66C 23/74; B66C 23/72; E02F 9/18; B62D 49/085
(Continued)

(56) References Cited

U.S. PATENT DOCUMENTS 2,130,487 A * 9/1938 Foley ..... B66C 23/36 212/196
4,349,115 A 9/1982 Lampson
(Continued)

FOREIGN PATENT DOCUMENTS

CN 101357741 2/2009
CN 201268560 7/2009
(Continued)

OTHER PUBLICATIONS

Machine Translation of CN 202754725 (Year: 2013).*
(Continued)

*Primary Examiner* — Minh Truong
*Assistant Examiner* — Juan J Campos, Jr.
(74) *Attorney, Agent, or Firm* — Wilmer Cutler Pickering Hale and Dorr LLP

(57) ABSTRACT

The present application relates to a mobile counterweight mechanism of a hoisting machine, comprising a support portion, a drive portion and a counterweight which is articulated to said support portion by means of a first articulation portion, said drive portion connected between said support portion and the counterweight so that said counterweight turns over outwards about said first articulation portion relative to a center of rotation of said hoisting machine, so as to increase a distance between a center of gravity of said counterweight and a center of rotation of said hoisting machine. The present application also relates to a hoisting machine. The present application raises a movement distance of a mobile counterweight and improves the overall stability of a hoisting machine in a turnover manner.

8 Claims, 2 Drawing Sheets

(58) Field of Classification Search
USPC ..... 212/195, 196
See application file for complete search history.

(56) References Cited

U.S. PATENT DOCUMENTS

| | | | | |
|---|---|---|---|---|
| 5,799,806 | A * | 9/1998 | Cullity | B66F 11/044 212/195 |
| 6,131,751 | A * | 10/2000 | Pech | B66C 23/36 212/178 |
| 2008/0099421 | A1* | 5/2008 | Pech | B66C 23/76 212/196 |
| 2008/0203045 | A1* | 8/2008 | Pech | B66C 23/76 212/270 |
| 2008/0264887 | A1* | 10/2008 | Porubcansky | B66C 23/76 212/198 |

FOREIGN PATENT DOCUMENTS

| | | |
|---|---|---|
| CN | 102229415 | 11/2011 |
| CN | 102583176 | 7/2012 |
| CN | 202754725 | 2/2013 |
| CN | 103539025 | 1/2014 |
| CN | 104528553 | 4/2015 |
| GB | 191305012 | 5/1913 |

OTHER PUBLICATIONS

Machine Translation of CN 103539025 (Year: 2014).*
International Search Report issued by the State Intellectual Property Office of the P.R. of China as International Searching Authority for International Application No. PCT/CN2015/071686 dated Nov. 20, 2015, 8 pages.

* cited by examiner

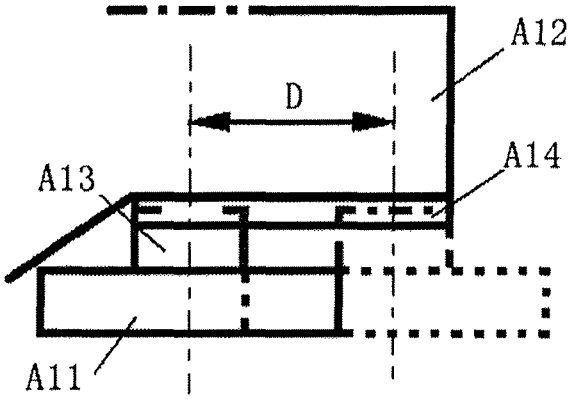
Figure 1--Prior Art
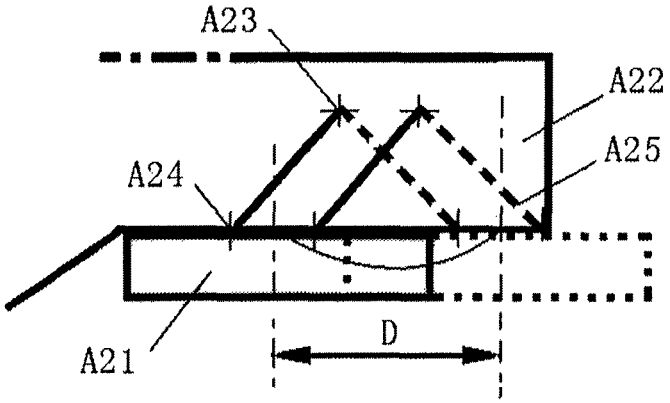
Figure 2--Prior Art

MOBILE COUNTERWEIGHT MECHANISM OF A HOISTING MACHINE AS WELL AS A HOISTING MACHINE

CROSS-REFERENCE TO RELATED APPLICATIONS

This application is a national stage application of International Application No. PCT/CN2015/071686, entitled "MOVABLE COUNTERWEIGHT MECHANISM OF HOISTING MACHINERY AND HOISTING MACHINERY," filed on Jan. 28, 2015, the disclosure of which is hereby incorporated by reference herein in its entirety.

FIELD OF THE APPLICATION

The present application relates to the field of an engineering machine, and in particular relates to a mobile counterweight mechanism of a hoisting machine as well as a hoisting machine.

BACKGROUND ART

As overall stability is one of the key indices affecting the hoisting performance of a hoisting machine, when a hoisting machine is designed, a counterweight mass tends to be increased to a bearable limit of an axle so as to improve the overall stability to a maximum extent. For a large-tonnage product, a combined counterweight manner tends to be used to improve the hoisting performance of a hoisting machine.

In principle, what actually affects the stability of a crane is a moment produced by a counterweight relative to a center of rotation. When a counterweight is set to be Q, and a distance of a center of gravity of the counterweight relative to a center of rotation is L, a moment of the counterweight acting on a center of rotation is: $w=Q\times L$. Thus, the overall stability of a crane may also be improved by increasing a distance between a center of gravity of a counterweight and a center of rotation.

For a small-tonnage product limited to an axle load, a counterweight mass significantly constrains the overall stability. Thus, to increase a distance between a center of gravity of a counterweight and a center of rotation is of vital importance for ensuring the overall hoisting performance. However, if various aspects such as distribution of an axle load, stability of a vehicle trip, safety and appearance molding are taken into account, the retraction distance of the counterweight is extremely limited. Accordingly, a solution widely adopted in industry is to retract a center of gravity of a counterweight during operation, and retrieve the same in a travelling state.

At present, there are two methods of effectuating promoting the overall stability by a counterweight action as follows:

1) Combined counterweight: limited by an axle load of a hoisting machine and considering the safety, a hoisting machine is only with less amount of counterweight, or even with no counterweight in the process of travel or transition. After a vehicle is positioned at a hoisting work area, a counterweight is hitched on a hoisting machine by means of a hydraulic cylinder or in other manners, and the overall hoisting stability is improved in such a manner as to increase the weight of a counterweight. However, the technical disadvantages of a combined counterweight solution comprise the following two aspects: a. the counterweight needs an additional vehicle for transportation so that the hoisting cost is increased; b. movement and hitching of the counterweight are realized in a hoisting manner, which also increases the hoisting cost.

2) Mobile counterweight: with certain weight for a counterweight of a hoisting machine, the overall stability is improved by an external force moving the counterweight outwards by certain distance relative to a center of rotation. There are two technical means in the realization manner, respectively a guide rail type and a connection rod type.

FIG. 1 illustrates a guide rail type counterweight movement solution, with a solid line indicating a travel (or transition state), and a dotted line indicating an operation state. Two guide rails A14 are respectively fixed to both sides at the bottom of a winch box A12 of a hoisting machine, and a slide block A13 is fixed to a counterweight A11. When the slide block A13 moves along the guide rail A14 under the impulse of an cylinder, the counterweight also moves by the same distance D.

FIG. 2 illustrates a connection rod type counterweight movement solution, with a solid line indicating a travel (or transition state), and a dotted line indicating an operation state. Two connection rods A25 are arranged in parallel, with an upper articulation point A23 fixed to the winch box and a lower articulation point A24 fixed to a counterweight A21, so as to effectuate an overall retraction distance D of the counterweight A21 by the cylinder pushing the lower articulation point A24 of the connection rods.

However, the aforementioned two technical means of a mobile counterweight are both present with the defect of a short movement distance (a movement distance of a guide rail type counterweight is restricted by rigidity of the guide rail, while the connection rod type solution is restricted by the stability of an action in the movement process). For a small-tonnage product with a light counterweight itself, if the movement distance is short, it is not prominent for the effect of promoting the overall stability, and it is impossible to possess an actual value in use with respect to the cost increased by a mobile counterweight.

CONTENTS OF THE APPLICATION

The object of the present application is to provide a mobile counterweight mechanism of a hoisting machine as well as a hoisting machine, so as to raise a movement distance of a mobile counterweight and improve the overall stability in a turnover manner.

To that effect, the present application sets forth a mobile counterweight mechanism of a hoisting machine, comprising a support portion, a drive portion and a counterweight which is articulated to the support portion by means of a first articulation portion, and the drive portion is connected between the support portion and the counterweight so that the counterweight turns over outwards about the first articulation portion relative to a center of rotation of the hoisting machine, so as to increase a distance between a center of gravity of the counterweight and a center of rotation of the hoisting machine.

Further, the drive portion comprises a drive cylinder, a cylinder block end of which is articulated to the support portion by means of a second articulation portion, and a piston rod end of the drive cylinder is articulated to the counterweight, such that the counterweight is capable of turning over outwards about the first articulation portion relative to a center of rotation of the hoisting machine, so as to increase a distance between a center of gravity of the counterweight and a center of rotation of the hoisting machine.

Further, the drive portion further comprises a slave cylinder, by means of which a piston rod end of the drive cylinder is articulated to the counterweight, and the slave cylinder is capable of locking the counterweight at an initial position and a post-turnover position of the counterweight.

Further, a cylinder block end of the slave cylinder is articulated to the support portion by means of a third articulation portion, a piston rod end of the slave cylinder is articulated to the counterweight by means of a fourth articulation portion; a piston rod end of the drive cylinder is articulated to a cylinder block of the slave cylinder by means of a fifth articulation portion.

Further, hydraulic control systems of the drive cylinder and the slave cylinder are independent from each other.

Further, a hydraulic control system of the slave cylinder comprises an oil tank, a first hydraulic control check valve, a second hydraulic control check valve and an electromagnetic switch valve, a rod cavity of the slave cylinder communicating with the oil tank through the first hydraulic control check valve, a rod-free cavity of the slave cylinder communicating with the oil tank through the second hydraulic control check valve; the electromagnetic switch valve is connected in parallel between the oil tank and the rod cavity of the slave cylinder; the first hydraulic control check valve and the electromagnetic switch valve are capable of effectuating locking the slave cylinder.

Further, the support portion is a winch box of the hoisting machine.

Further, at a post-turnover position of the counterweight relative to its initial position, a center of gravity of the counterweight is raised.

Further, the support portion has an exterior vertical face, at a bottom end of which the first articulation portion is located so that the counterweight is capable of turning over 180° horizontally about the first articulation portion.

The present application also provides a hoisting machine, which comprises the aforementioned mobile counterweight mechanism.

The drive manner of the present application effectuates overall horizontal turnover of a hoisting counterweight, increasing a distance of the counterweight relative to a center of rotation, and improving the overall stability.

BRIEF DESCRIPTION OF THE DRAWINGS

FIG. 1 is a schematic view of a counterweight movement manner of the prior art.

FIG. 2 is a schematic view of another counterweight movement manner of the prior art.

EMBODIMENTS

Next, the technical solution of the present application is further described in detail by means of the drawings and embodiments.

Figure 3:
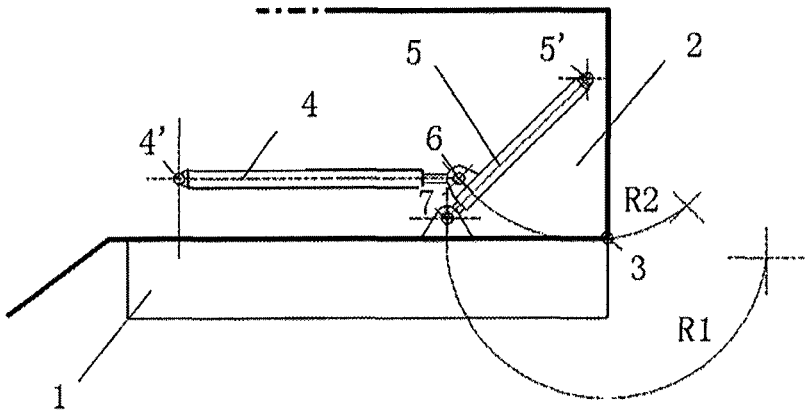
FIG. 3 is a schematic view of an embodiment of the mobile counterweight mechanism according to the present application.

FIG. 3 is a schematic view of an embodiment of the mobile counterweight mechanism of a hoisting machine according to the present application, which comprises a support portion 2, a drive portion and a counterweight 1. The support portion here may be at a proper position of the hoisting machine, as long as bearing of the counterweight can be realized. The counterweight 1 is articulated to the support portion 2 by means of a first articulation portion 3, the drive portion is connected between the support portion 2 and the counterweight 1 so that the counterweight 1 turns over outwards about the first articulation portion 3 relative to a center of rotation of the hoisting machine, so as to increase a distance between a center of gravity of the counterweight 1 and a center of rotation of the hoisting machine. The technical means of current mobile counterweights are all present with the defect of a short movement distance, for example a movement distance of a guide rail type counterweight is restricted by rigidity of the guide rail, while the connection rod type solution is restricted by the stability of an action in the movement process. If the movement distance is short, it is not prominent for the effect of promoting the overall stability, and it is impossible to possess an actual value in use with respect to the cost increased by a mobile counterweight. Considering from the perspective of movement of a center of gravity, the present application uses a turnover counterweight solution, which presents the advantage of a great movement distance.

Figure 4:
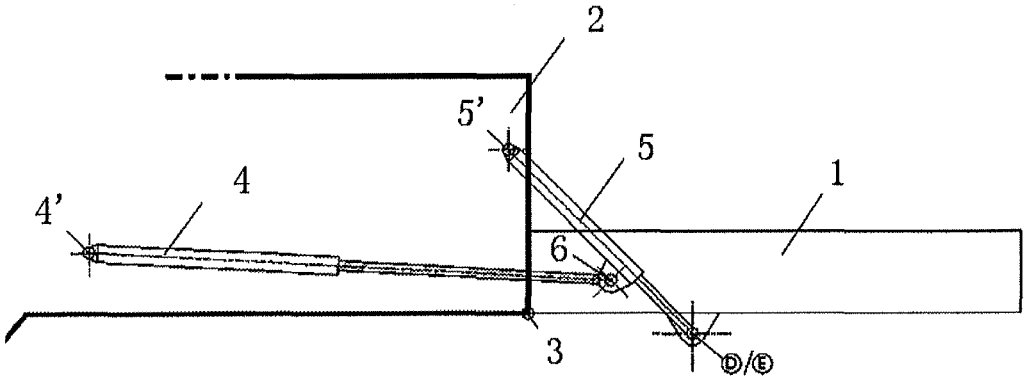
FIG. 4 is a schematic view of a counterweight of an embodiment of the mobile counterweight mechanism after horizontal turnover according to the present application.

The drive portion is explained as follows. As shown in FIGS. 3 and 4, the drive portion comprises a drive cylinder 4, a cylinder block end of which is articulated to the support portion 2 by means of a second articulation portion 4', a piston rod end of the drive cylinder 4 being articulated to the counterweight 1, such that the counterweight 1 is capable of turning over outwards about the first articulation portion 3 relative to a center of rotation of the hoisting machine, so as to increase a distance between a center of gravity of the counterweight 1 and a center of rotation of the hoisting machine. Certainly, as the drive portion is not only limited to a form of an cylinder, any drive structure capable of effectuating outward turnover of the counterweight may be used.

In order to ensure the stability, the drive portion further comprises a slave cylinder 5, by means of which a piston rod end of the drive cylinder 4 is articulated to the counterweight 1, and the slave cylinder 5 is capable of locking the counterweight 1 at an initial position and a post-turnover position of the counterweight 1. In this way, the follower cylinder is controlled to ensure that, at an initial position and a post-turnover position, the counterweight has a very stable support, thereby improving the stability of the system.

Specifically, a cylinder block end of the slave cylinder 5 is articulated to the support portion 2 by means of a third articulation portion 5', a piston rod end of the slave cylinder 5 is articulated to the counterweight 1 by means of a fourth articulation portion 7; a piston rod end of the drive cylinder 4 is articulated to a cylinder block of the slave cylinder 5 by means of a fifth articulation portion 6. In the process of turning over the counterweight, the slave cylinder rotates about the third articulation portion 5', and in such process, an extreme point of the piston thereof extends from a length of R1 to a length of R2, so as to adapt to a turnover action of the counterweight.

In order to facilitate better control, hydraulic control systems of the drive cylinder 4 and the slave cylinder 5 are independent from each other. Next, explanations are mainly made to a hydraulic system of the slave cylinder 5.

Figure 5:
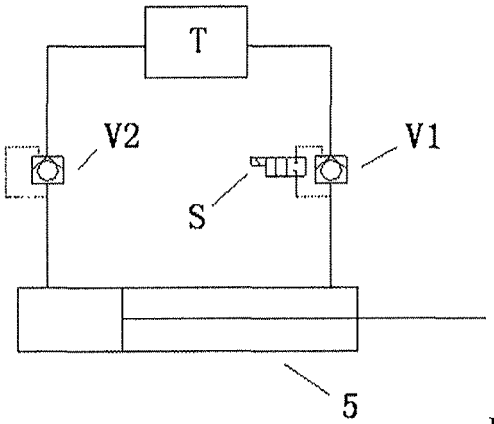
FIG. 5 is a view of hydraulic principles of a slave cylinder of an embodiment of the mobile counterweight mechanism according to the present application.

Specifically, as shown in FIG. 5, a hydraulic control system of the slave cylinder 5 comprises an oil tank T, a first hydraulic control check valve V1, a second hydraulic control check valve V2 and an electromagnetic switch valve S, a rod cavity of the slave cylinder 5 communicating with the oil tank T through the first hydraulic control check valve V1, a rod-free cavity of the slave cylinder 5 communicating with the oil tank T through the second hydraulic control check valve V2; the electromagnetic switch valve S is connected in parallel between the oil tank T and the rod cavity of the slave cylinder 5; the first hydraulic control check valve V1 and the electromagnetic switch valve S are capable of effectuating locking the slave cylinder 5. Thus, when a piston of the slave cylinder 5 extends, the electromagnetic switch valve S is opened so that hydraulic oil from the rod cavity flows back to the oil tank via the electromagnetic switch valve S; when the counterweight turns over to a designated position, the electromagnetic switch valve S is closed so that the electromagnetic switch valve S and the check valve prevent backflow of an oil path from the rod cavity to the oil tank so as to effectuate position locking; in the process of counterweight resetting, pressure oil flows back from the rod-free cavity to the oil tank T via a second hydraulic control check valve V2, and pressure oil enters the rod cavity from the oil tank via the first hydraulic control check valve V2, so as to effectuate contracting the piston rod of the slave cylinder.

For the aforementioned support portion 2, in one embodiment of the present application, the support portion 2 is a winch box of the hoisting machine.

In order to prevent interference caused by the counterweight to the bottom structure in the operation process, accordingly, in an embodiment, at a post-turnover position of the counterweight 1 relative to its initial position, a center of gravity of the counterweight 1 is raised.

At the same time, in order to ensure that the counterweight presents a favorable stability at a post-turnover position, the support portion 2 has an exterior vertical face, at a bottom end of which the first articulation portion 3 is located so that the counterweight 1 is capable of turning over 180° horizontally about the first articulation portion 3.

The present application also provides a hoisting machine, which comprises the aforementioned mobile counterweight mechanism.

Finally, it should be explained that: the aforementioned embodiments are only used to describe the technical solution of the present application rather than limiting the same; although detailed explanations are made to the present application by referring to preferred embodiments, a common technical person in the art should understand that: it is still possible to make amendments to the embodiments of the present application or make equivalent replacements to part of the technical features; without departing from the spirit and scope of the present application, they should all be covered in the scope of the technical solution for which protection is sought in the present application.

The invention claimed is:

1. A mobile counterweight mechanism of a hoisting machine, comprising a support portion, a drive portion and a counterweight which is articulated to said support portion by means of a first articulation portion, said drive portion being connected between said support portion and the counterweight, so that said counterweight turns over outwards about said first articulation portion relative to a center of rotation of said hoisting machine, so as to increase a distance between a center of gravity of said counterweight and a center of rotation of said hoisting machine, said drive portion comprises a drive cylinder, a cylinder block end of which is articulated to said support portion by means of a second articulation portion, a piston rod end of said drive cylinder being articulated to said counterweight, such that said counterweight is capable of turning over outwards about said first articulation portion relative to a center of rotation of said hoisting machine, so as to increase a distance between a center of gravity of said counterweight and a center of rotation of said hoisting machine, said drive portion further comprises a slave cylinder, by means of which a piston rod end of said slave cylinder is articulated to said counterweight, said slave cylinder being capable of locking said counterweight at an initial position and a post-turnover position of said counterweight.

2. The mobile counterweight mechanism of a hoisting machine according to claim 1, wherein a cylinder block end of said slave cylinder is articulated to said support portion by means of a third articulation portion, a piston rod end of said slave cylinder being articulated to said counterweight by means of a fourth articulation portion; a piston rod end of said drive cylinder is articulated to a cylinder block of said salve cylinder by means of a fifth articulation portion.

3. The mobile counterweight mechanism of a hoisting machine according to claim 2, wherein hydraulic control systems of said drive cylinder and said slave cylinder are independent from each other.

4. The mobile counterweight mechanism of a hoisting machine according to claim 3, wherein a hydraulic control system of said slave cylinder comprises an oil tank, a first hydraulic control check valve, a second hydraulic control check valve and an electromagnetic switch valve, a rod cavity of said slave cylinder communicating with said oil tank through said first hydraulic control check valve, a rod-free cavity of said salve cylinder communicating with said oil tank through said second hydraulic control check valve; said electromagnetic switch valve is connected in parallel between said oil tank and the rod cavity of said slave cylinder; said first hydraulic control check valve and said electromagnetic switch valve are capable of effectuating locking said slave cylinder.

5. The mobile counterweight mechanism of a hoisting machine according to claim 1, wherein said support portion is a winch box of said hoisting machine.

6. The mobile counterweight mechanism of a hoisting machine according to claim 1, wherein a center of gravity of said counterweight at a post-turnover position is higher than that at an initial position of the counterweight.

7. The mobile counterweight mechanism of a hoisting machine according to claim 1, wherein said support portion has an exterior vertical face, at a bottom end of which said first articulation portion is located so that said counterweight is capable of turning over 180° horizontally about said first articulation portion.

8. A hoisting machine, comprising the mobile counterweight mechanism of a hoisting machine according to claim 1.

* * * * *